US005230511A

United States Patent [19]

Gubany

[11] Patent Number: 5,230,511

[45] Date of Patent: Jul. 27, 1993

[54] YARD GOLF GAME APPARATUS

[76] Inventor: Peter M. Gubany, 6 Oakbriar Farm Ct., St. Louis, Mo. 63021

[21] Appl. No.: 952,311

[22] Filed: Sep. 28, 1992

[51] Int. Cl.[5] ..... A63B 69/36

[52] U.S. Cl. ..... 273/178 R; 273/34 B; 273/180

[58] Field of Search ..... 273/178 R, 178 A, 178 B, 273/179 R, 179 A, 179 B, 179 C, 179 D, 179 E, 180, 176 B, 181 A, 34 B

[56] References Cited

U.S. PATENT DOCUMENTS 3,797,833 3/1974 Rokusek ..... 273/178 R
4,878,671 11/1989 Gubany ..... 273/176 R
4,906,006 3/1990 Sigunick ..... 273/178 R

*Primary Examiner*—George J. Marlo

*Attorney, Agent, or Firm*—Armstrong, Teasdale, Schlafly & Davis

[57] ABSTRACT

A simulated hole apparatus for use in a golf-type game in which players strike a ball to propel it into the hole, includes a circular cup for receiving the ball, surrounded by a frustoconical flange that slopes downwardly and radially outwardly from the rim of the cup. A flag pole extends vertically upwardly from the center of the cup, and has a frustoconical base resting on the bottom of the cup. The frustoconical base of the flag pole and the sloped sidewall of the cup define an annular ball-receiving space between them, whose sides converge to trap a ball between them.

One or more annular inserts and corresponding replacement flag pole bases can be provided to decrease the size of the ball-receiving space while maintaining a converging configuration for the walls of the ball-receiving space.

16 Claims, 2 Drawing Sheets

FIG. 4A.
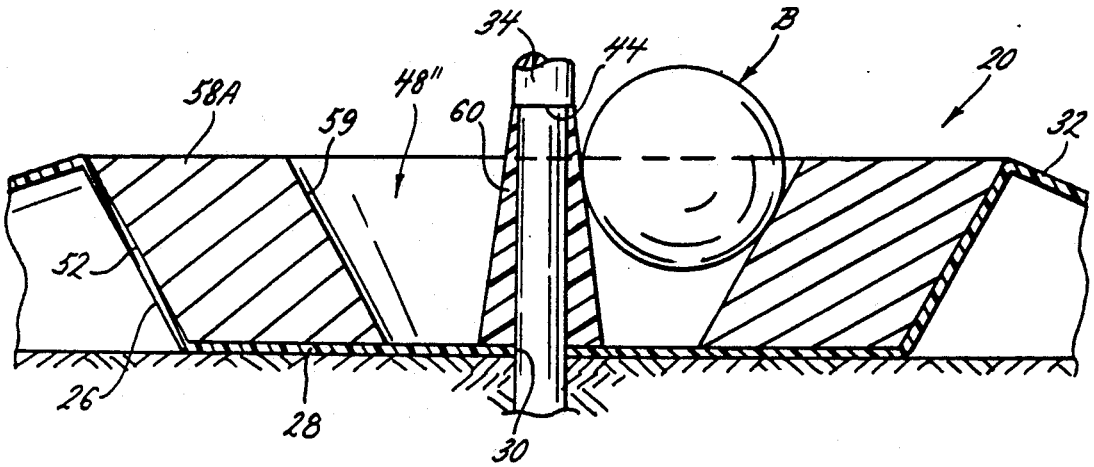
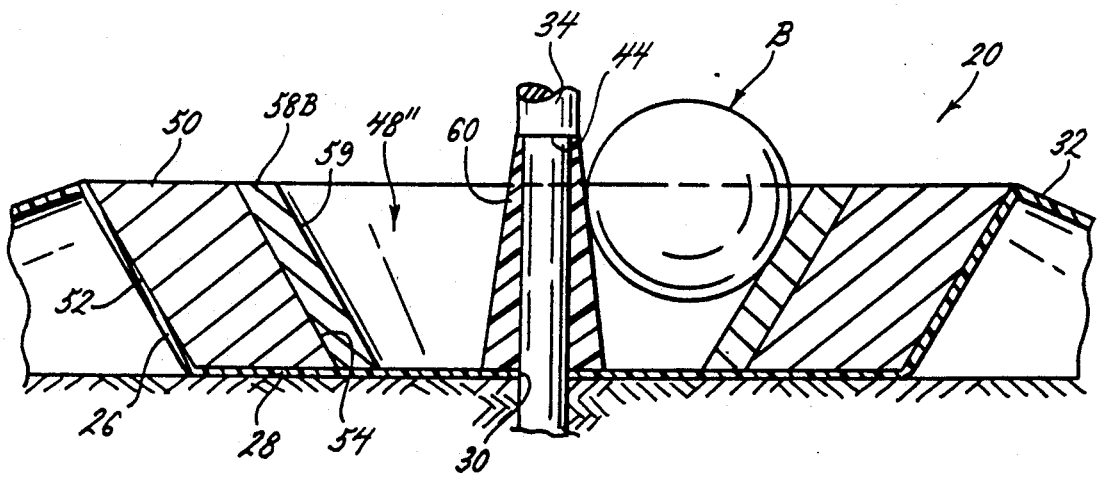
FIG. 4B.

YARD GOLF GAME APPARATUS

BACKGROUND OF THE INVENTION

This invention relates to equipment for playing a yard golf-type game.

The inventor's prior U.S. Pat. No. 4,878,671, discloses a yard golf game apparatus that provided a golf "hole" for a yard golf-type game that did not require a hole to be dug in the yard. This apparatus had many advantages, including providing a hole with a smooth approach so that a ball could be easily hit into the hole. The present invention relates to improvements to this type of game apparatus. These improvements reduce the incidence of balls bouncing out of the hole when they are properly struck into the hole. These improvements also relate to varying the degree of difficulty of the game, to provide an increased challenge, or to allow a competitive game among players of differing ages and abilities.

Generally, the game apparatus of the present invention comprises a generally circular cup having a sloped sidewall and a bottom. A generally frustoconical flange surrounds the cup, sloping downwardly and outwardly from the rim of the cup. A flag pole extends vertically upwardly, generally from the center of the cup. The flag pole and the sidewall of the cup define an annular ball-receiving space between them. The flag pole has a frustoconical base, which together with the sloped sidewall of the cup form converging walls in the annular ball-receiving space, so that a ball entering the ball-receiving space is pinched or trapped between the sidewalls and is less likely to bounce out of the hole.

According to one embodiment of the game apparatus, one or more inserts are provided that can be fit into the cup against the sidewall to constrict the size of the opening, thereby increasing the difficulty of the game. Replacement frustoconical bases of steeper inclinations are preferably also provided for each insert to maintain a sufficient sized opening to receive the ball, and to maintain a proper converging wall configuration for trapping the ball in the ball-receiving space.

Thus, the game apparatus of the present invention provides an annular ball-receiving space with converging walls that trap a ball hit into the space, reducing the incidence of the ball bouncing out of the cup. The game apparatus can be quickly and easily converted into a more difficult mode by installing one or more inserts into the cup, and replacing the flag base, in order to make the game more challenging, or to accommodate players of different levels of skill. These and other features and advantages will be in part apparent, and in part pointed out hereinafter.

BRIEF DESCRIPTION OF THE DRAWINGS

FIG. 4A is a partial vertical cross-sectional view of the game apparatus showing a replacement insert and corresponding replacement flag base installed therein; and FIG. 4B is a partial vertical cross-sectional view of the game apparatus showing an alternative replacement insert and corresponding replacement flag base installed therein.

Corresponding reference numerals indicate corresponding parts throughout the several views of the drawings.

DETAILED DESCRIPTION OF THE PREFERRED EMBODIMENTS

Figure 1:
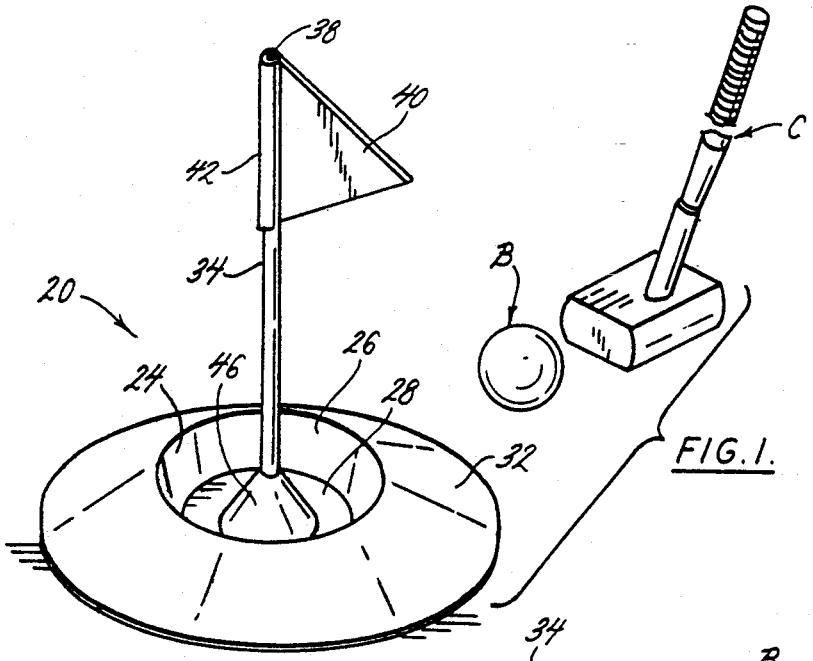
FIG. 1 is a perspective view of a game apparatus for playing a yard golf-type game, constructed according to the principles of this invention.

A yard golf game apparatus constructed according to the principles of this invention is indicated generally as 20 in FIGS. 1–4. The apparatus 20 is adapted to be used with one or more clubs C, which are used to hit a ball B into the "hole" formed by the game apparatus 20. The apparatus 20 comprises a generally circular cup 24, having a sidewall 26 and a bottom 28. The sidewall 26 is sloped, generally downwardly and radially inwardly. The downward slope of the sidewall 26 is preferably at least 45°, so that the sidewall does not tend to cause a ball to bounce up. There is an opening 30 in the bottom 28 of the cup 24, generally in the center. A generally frustoconical flange 32 surrounds the cup 24, sloping downwardly and radially outwardly from the rim of the cup.

A flag pole 34 extends vertically upwardly, generally from the center of the cup 24. The pole 34 preferably extends through the opening 30 in the bottom 28 of the cup 24. The lower end 36 of the flag pole 34 is pointed to facilitate its insertion into the ground below the apparatus 20 to anchor the apparatus. The upper end 38 of the flag pole 34 is preferably rounded, and is adapted to mount a generally triangular flag 40. The flag 40 can be made from a rigid plastic sheet, bent to form an integral sleeve 42 for mounting the flag on the upper end 38 of the flag pole.

There is preferably a shoulder 44 in the lower portion of the flag pole 34, which engages a generally frustoconical base 46. The base angle of the frustoconical base 46 is preferably at least 45°, so that the base does not tend to cause a ball to bounce upwardly out of the hole. The pole 34 and the sidewall 26 of the cup 24 define an annular ball-receiving space 48 between them. Because of the frustoconical shape of the base 46 and the sloped sidewall 26 of the cup 24, the walls of the ball-receiving space 48 converge. The angle subtended by the sidewall 26 and the base 46 is preferably 90° or less. The converging configuration of the walls traps a ball B that is struck into the space 48, with a wedging action that engages the ball preferably before the ball can bounce off the bottom 28 of the cup. Thus, this configuration reduces the tendency of the ball B to bounce out of the hole.

Figure 3:
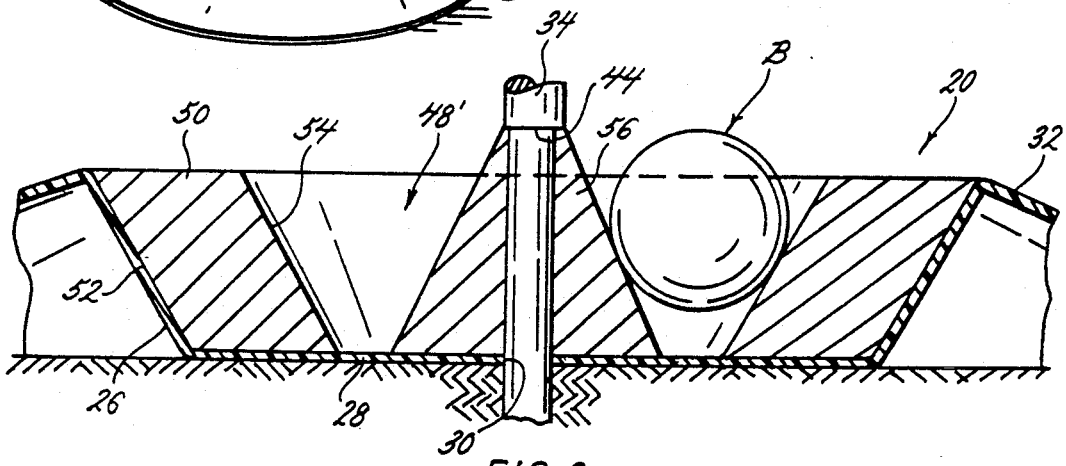
FIG. 3 is a partial vertical cross-sectional view of the game apparatus, showing an insert and corresponding replacement flag base installed therein to increase the difficulty of the game.
Figure 2:
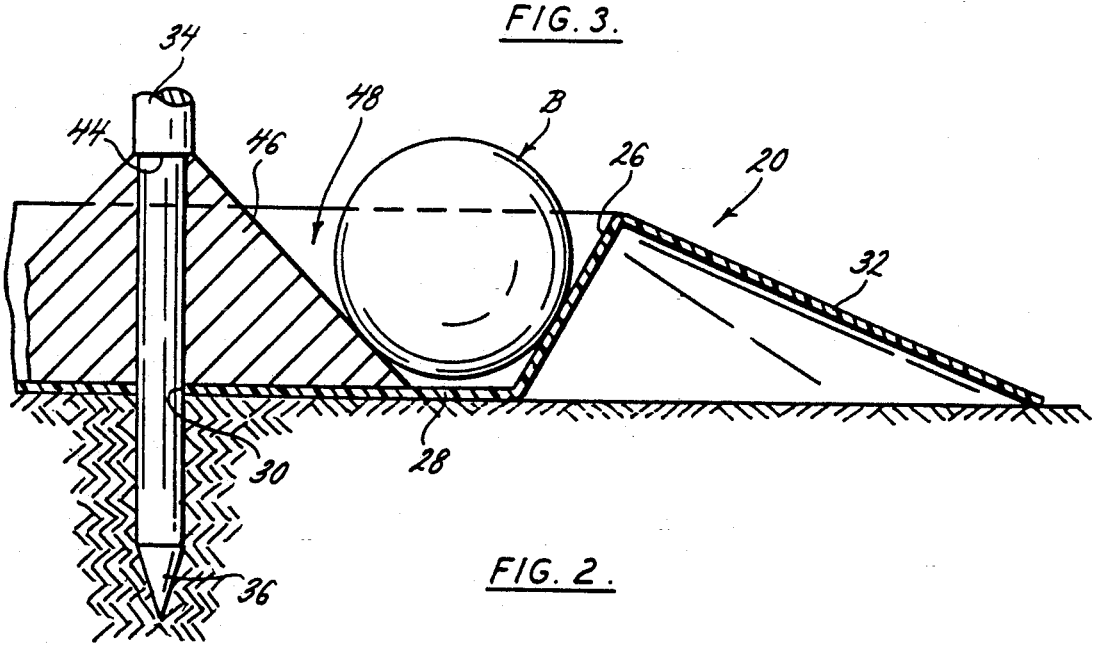
FIG. 2 is a partial vertical cross-sectional view of the game apparatus.

As shown in FIG. 3, the apparatus preferably also includes an annular insert 50 adapted to fit into the cup 24 to reduce the size of the opening of the ball-receiving space 48. The outside 52 of the insert 50 is configured to fit flushly against the sidewall 26 of the cup 24. The inside 54 of the insert 50 is sloped to provide a downwardly, radially inwardly sloped surface, like the sidewall 26 that it replaces. A replacement flag pole base 56 is preferably provided for each insert 50. The replacement base 56 is frustoconical like the base 46 that it replaces, but has a steeper slope so that the ball receiving space 48', between the replacement base and the inside side of the insert is smaller than the ball receiving space 48, and so that the walls of the space converge to achieve the appropriate wedging action to help trap the ball B within the cup 24. The smaller dimension of the opening of ball-receiving space 48' makes the game more challenging, and makes the game more interesting and competitive for players of differing levels of skill.

As shown in FIGS. 4A and 4B, a second insert and a second replacement flag pole base can be provided to provide an even smaller ball-receiving space 48" for an even more difficult game. As shown in FIG. 4A, the second insert 58A can have the same outside dimension as the insert 50, with a smaller inside dimension, and can be used in place of the insert 50, to provide a smaller opening in which the ball can be received. Alternatively, as shown in FIG. 4B, the second insert 58B can have an outside dimension corresponding to the inside dimension of insert 50, so that it can fit inside of the insert 50, to provide a smaller opening in which the ball can be received. Inserts 58A and 58B are collectively referred to as insert 58 hereafter. The inside 59 of the insert 58 is sloped to provide a downwardly, radially inwardly sloped surface, like the sidewall 26 that it replaces. The replacement base 60 is frustoconical like the base 46 and the replacement base 56, that it replaces, but has a steeper slope than either of these bases so that the ball receiving space 48,, between the replacement base 54 and the inside side of the insert 58 is smaller than the ball receiving space 48 or 48', and so that the walls of the ball-receiving space converge to achieve the appropriate wedging action to help trap the ball B within the cup. The smaller dimension of the opening of space 46" makes the game more challenging, and makes the game more interesting and competitive for players of differing levels of skill.

In accordance with the teachings of the inventor's prior U.S. Pat. No. 4,878,671, (which is incorporated herein by reference), the flange 32 can be made from a resilient flexible material, and can be sized and shaped so that in its uncompressed state, the rim of the flange is below the bottom 28 of the cup 24. Thus, when the flag pole 34 is inserted through the opening 30 in the bottom 28 of the cup 24, the base 46 (or replacement base 56 or 60) pushes the bottom of the cup down toward the ground, compressing the flange 32 and thereby causing the rim of the flange to press firmly against the ground, providing a smooth continuous transition from the ground to the cup.

Because of the unique wedging action achieved between the sloped sidewall of the cup and the frustoconical base of the flag pole, a ball struck into the ball-receiving space is far less likely to bounce out. The inserts 50 and 58, and the replacement bases 56 and 60 for the flag pole 34 make it possible to modify the game to make it more difficult to hit a ball into the hole. This makes the game more challenging and interesting for experienced players, and allows the game to be played competitively by players of different levels of skill. Moreover the inserts 50 and 58 and the replacement bases 56 and 60 are configured to maintain the unique wedging action, which is particularly desirable as the size of ball-receiving space is reduced.

OPERATION

In operation, the apparatus 20 is set up for play by placing the apparatus 20 in an appropriate location in the yard. The base 46 is installed on the end of the flag pole 34, and the end of the flag pole is inserted through the opening 30 in the bottom 28 of the cup 24 and into the ground. The base 46 engages the bottom of the cup, pressing it down against the ground, thereby compressing the flange 32, forcing the rim of the flange against the ground.

The device is ready for use. When a ball B is properly struck with club C, it rolls up the flange 32, and falls into the ball-receiving space 48 in the cup 24. Because of the walls of the ball-receiving space 48 converge, the walls wedge the ball before the ball bounces on the bottom of the cup, thereby reducing the incidence of the ball bouncing out of the cup.

When it is desired to increase the difficulty of the game, the flag pole is pulled up, and the base 46 is replaced with base 52. Then insert 50 is inserted into the cup, creating a ball-receiving space 48' of reduced size through which the ball can drop into the cup. The replacement base 56 and the insert 50 are preferably configured to maintain the converging configuration of the walls of space 48' so that a ball that successfully enters the space wedges against the converging opposed walls before it bounces off the bottom of the cup.

When it is desired to further increase the difficulty of the game, the flag pole is pulled up, and the base 46 or 58 is replaced with base 60. Then insert 58 is inserted into the cup, creating a ball-receiving space 48" of reduced size through which the ball can drop into the cup. The replacement base 60 and the insert 58 are preferably configured to maintain the converging configuration of the walls of space 48" so that a ball that successfully enters the space wedges against the converging opposed walls before it bounces off the bottom of the cup.

Thus the invention provides a more pleasant and less frustrating game, that is challenging to persons with a wide range of levels of skill.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A simulated hole apparatus for use in a golf-type game in which players strike a ball to propel it into the hole, the device comprising:

a generally circular cup having a sidewall and a bottom for receiving the ball;

a generally frustoconical flange surrounding the cup, the flange sloping downwardly and radially outwardly from the rim of the cup;

a flag pole extending vertically upwardly generally from the center of the cup, the flag pole and the sidewall of the cup defining an annular ball-receiving space between them, the flag pole having a frustoconical base with its larger diameter lowermost and resting on the bottom of said cup, and the cup having a sloped sidewall so that the sides of the annular ball-receiving space converge to trap a ball between them.

2. The apparatus according to claim 1 wherein the sidewall of the cup and the frustoconical base of the flag pole are configured to engage the ball before the ball contacts the bottom of the cup.

3. The apparatus according to claim 1 further comprising an annular insert that can be fit into the cup to reduce the size of the annular ball-receiving space.

4. The apparatus according to claim 3 wherein the annular insert has a sloped surface to maintain the converging configuration of the walls of the annular ball-receiving space.

5. The apparatus according to claim 3 wherein the annular insert fits against the sidewall of the cup and wherein the ball-receiving space is defined between the annular insert and the frustoconical base of the flag pole.

6. The apparatus according to claim 1 wherein the cup has an opening generally in its center, and wherein the flag pole extends through the opening in the cup and into the ground below the apparatus to anchor the apparatus.

7. The apparatus according to claim 1 further comprising an annular insert that can be fit into the cup to reduce the size of the annular ball-receiving space.

8. A simulated hole apparatus for use in a golf-type game in which players strike a ball to propel it into the hole, the device comprising:

a generally circular cup for receiving the ball, the cup having a sloped sidewall, a bottom and an opening generally in the center of the cup;

a generally frustoconical flange surrounding the cup, the flange sloping downwardly and radially outwardly from the rim of the cup;

a flag pole extending though the opening in the cup to anchor the apparatus, the flag pole and the sidewall of the cup defining an annular space between them for receiving the ball;

a first frustoconical base for the flag, which when installed in the cup with its larger diameter lowermost and resting on said bottom gives the annular ball-receiving space a first dimension with converging sidewalls for trapping a ball hit into the space; and an annular insert adapted to fit in the hole against the sidewall of the cup, and a second frustoconical base for the flag, having a steeper slope than the first frustoconical base, for replacing the first frustoconical base when the annular insert is installed the cup, the annular insert and the second frustoconical base giving the annular ball-receiving space a second dimension, smaller than the first dimension, and forming converging sidewalls for trapping a ball hit into the space.

9. The apparatus according to claim 8 wherein sidewall of the cup and the frustoconical base of the flag pole are configured to engage the ball before the ball contacts the bottom of the cup.

10. The apparatus according to claim 8 wherein the annular insert has a sloped surface to maintain the converging configuration of the walls of the annular ball-receiving space.

11. The apparatus according to claim 8 wherein the annular insert fits against the sidewall of the cup and wherein the ball-receiving space is defined between the annular insert and the frustoconical base of the flag pole.

12. A hole simulating apparatus for a golf-type game in which players strike a ball to propel it in to the hole, the device comprising:

a generally circular cup having a sidewall and a bottom into which players attempt to hit the ball, and having an opening generally in its center;

a generally frustoconical resilient flange surrounding the cup, the flange sloping downwardly and radially outwardly from the rim of the cup, the lower lip of the flange extending below the bottom of the cup in its uncompressed state;

a flag pole for anchoring the apparatus, the flag pole extending through the opening in the cup and into the ground below the device, the flag having a base for engaging the bottom of the cup to hold the cup down and compress the resilient flange to hold the lip of the flange against the ground, the flag pole and the sidewall of the cup defining an annular ball-receiving space between them, the base of the flag pole being frustoconical with its larger diameter lowermost and resting on said bottom, and the cup having a sloped sidewall so that the sides of the annular ball-receiving space converge to trap a ball between them.

13. The apparatus according to claim 12 wherein the sidewall of the cup and the conical base of the flag pole are configured to engage the ball before the ball contacts the bottom of the cup.

14. The apparatus according to claim 12 further comprising an annular insert that can be fit into the cup between the side wall and the frustoconical base of the flag pole to reduce the size of the annular ball-receiving space.

15. The apparatus according to claim 14 wherein the annular insert has a sloped surface to maintain the converging configuration of the walls of the annular ball-receiving space.

16. The apparatus according to claim 15 wherein the annular insert fits against the sidewall of the cup and wherein the ball-receiving space is defined between the annular insert and the frustoconical base of the flag pole.

* * * * *